US008219442B2

(12) United States Patent
Johnson et al.

(10) Patent No.: US 8,219,442 B2
(45) Date of Patent: Jul. 10, 2012

(54) PERMIT-BASED PARKING ENVIRONMENT MANAGEMENT METHOD AND SYSTEM

(75) Inventors: Josiah Johnson, Bedminster, NJ (US); Lawrence Berman, Delray Beach, FL (US); Cory Marchasin, Lambertville, NJ (US); Patrick Moynihan, Bedminster, NJ (US)

(73) Assignee: IPT, LLC, Somerville, NJ (US)

( * ) Notice: Subject to any disclaimer, the term of this patent is extended or adjusted under 35 U.S.C. 154(b) by 611 days.

(21) Appl. No.: 11/281,841

(22) Filed: Nov. 16, 2005

(65) Prior Publication Data

US 2007/0112620 A1 May 17, 2007

(51) Int. Cl.
*G06Q 99/00* (2006.01)

(52) U.S. Cl. ..... 705/13; 368/7; 340/932.2; 340/933

(58) Field of Classification Search ..... 707/9, 1; 705/13, 1; 368/7; 340/932.2, 933
See application file for complete search history.

(56) References Cited

U.S. PATENT DOCUMENTS

| | | | |
|---|---|---|---|
| 1,489,272 | A | 4/1924 | Murrah |
| 1,530,622 | A | 3/1925 | Roberts |
| 2,960,857 | A | 11/1960 | Winter |
| 3,907,072 | A | 9/1975 | Shafer |
| 4,509,347 | A | 4/1985 | Young |
| 4,649,724 | A | 3/1987 | Raine |
| 4,768,359 | A | 9/1988 | Wade |
| 4,770,013 | A | 9/1988 | Nakai |
| 4,881,766 | A | 11/1989 | Schmidt et al. |
| 5,134,868 | A | 8/1992 | Bethards |
| 5,315,848 | A | 5/1994 | Beyer |
| 5,372,018 | A | 12/1994 | Smith |
| 5,385,038 | A | 1/1995 | Walker |
| 5,412,963 | A | 5/1995 | Carlo et al. |
| 5,636,537 | A | 6/1997 | Chen |
| 5,673,574 | A | 10/1997 | Bertram |
| 5,740,050 | A | 4/1998 | Ward, II |
| 5,819,234 | A | 10/1998 | Slavin et al. |

(Continued)

FOREIGN PATENT DOCUMENTS

CA 608990 11/1960

(Continued)

OTHER PUBLICATIONS

PCT/US2006/11725 International Search Report—Issued Dec. 20, 2007.

*Primary Examiner* — Akiba Robinson Boyce
(74) *Attorney, Agent, or Firm* — Sills Cummis & Gross P.C.

(57) ABSTRACT

A system and method for managing a permit-based parking environment governed by a parking program. The permit-based parking environment includes a number of parking permits each including a unique RFID tag and tag number. One or more RFID readers are used to scan the vehicles parked in the parking environment to determine if a RFID tag is associated with the parked vehicle. The results of the scan along with information related to the parked vehicle are provided to a permit management system to determine if the vehicle is parked within the scope of privileges pre-defined for that vehicle, pursuant to the parking program governing the parking environment. The permit management system stores, manages, and monitors data related to the permits controlled under the parking program.

22 Claims, 4 Drawing Sheets

U.S. PATENT DOCUMENTS

| | | | | |
|---|---|---|---|---|
| 5,829,285 | A | 11/1998 | Wilson | |
| 5,862,688 | A | 1/1999 | Odegard | |
| 6,032,497 | A | 3/2000 | Fulcher et al. | |
| 6,049,269 | A | 4/2000 | Byrd et al. | |
| 6,265,973 | B1 | 7/2001 | Brammall et al. | |
| 6,490,443 | B1 | 12/2002 | Freeny, Jr. | |
| 6,522,264 | B1 | 2/2003 | Stewart | |
| 6,693,539 | B2 | 2/2004 | Bowers et al. | |
| 6,736,315 | B2 | 2/2004 | Neumark | |
| 6,714,121 | B1 | 3/2004 | Moore | |
| 6,734,795 | B2 | 5/2004 | Price | |
| 6,738,628 | B1 | 5/2004 | McCall et al. | |
| 6,745,603 | B1 | 6/2004 | Shaw | |
| 7,207,041 | B2 * | 4/2007 | Elson et al. | 718/104 |
| 2001/0018660 | A1 * | 8/2001 | Sehr | 705/5 |
| 2002/0063154 | A1 * | 5/2002 | Hoyos et al. | 235/382.5 |
| 2002/0163443 | A1 | 11/2002 | Stewart et al. | |
| 2003/0222792 | A1 | 12/2003 | Berman et al. | |
| 2004/0227616 | A1 | 11/2004 | Lafferty | |
| 2004/0254840 | A1 | 12/2004 | Slemmer et al. | |
| 2005/0068196 | A1 | 3/2005 | Marin | |
| 2005/0088320 | A1 | 4/2005 | Kovach | |
| 2005/0265263 | A1 * | 12/2005 | Wajda | 370/259 |
| 2006/0015397 | A1 * | 1/2006 | Vitrano et al. | 705/13 |
| 2006/0250278 | A1 * | 11/2006 | Tillotson et al. | 340/932.2 |
| 2006/0255119 | A1 * | 11/2006 | Marchasin et al. | 235/375 |
| 2008/0218383 | A1 * | 9/2008 | Franklin et al. | 340/937 |
| 2008/0231470 | A1 * | 9/2008 | Ioli | 340/932.2 |

FOREIGN PATENT DOCUMENTS

| | | | |
|---|---|---|---|
| CH | 672617 | A5 | 12/1989 |
| DE | 19902688 | A1 * | 8/2000 |
| GB | 489155 | A | 7/1938 |
| GB | 3003281 | | 8/2002 |
| GB | 3007353 | | 10/2002 |
| GB | 3009101 | | 2/2003 |
| GB | 3008370 | | 11/2003 |
| JP | 58-076348 | | 5/1983 |
| JP | 2002-208043 | | 7/2002 |
| JP | 2004-199604 | | 7/2004 |
| WO | WO-98/12083 | A | 3/1998 |
| WO | WO2006056970 | A1 * | 11/2004 |

* cited by examiner

PERMIT-BASED PARKING ENVIRONMENT MANAGEMENT METHOD AND SYSTEM

FIELD OF THE INVENTION

The present invention relates generally to parking permits, and, more particularly, to a system and method for administering, managing, and monitoring permit-based parking programs.

BACKGROUND OF THE INVENTION

Publicly and privately administered parking programs continually struggle with the seemingly intractable problem of providing parking services for an area having a limited number of parking spaces to an ever increasing number of vehicles. Specifically, there is an increasing effort to manage the problem in residential communities, where cities and towns attempt to provide the local residents with a place to park. This effort generally involves the use of permit-based parking programs.

Permit-based parking programs restrict parking privileges in an attempt to assure residents that the local residents are able to find a place to park their vehicles on a street or in a lot. The goal of such programs is to encourage persons to obtain a permit for parking privileges, or, alternatively, move non-permit holder vehicles, to metered, time-limited, or garage parking.

However, such programs are very difficult and expensive to implement and manage. Inefficiencies in the administration of these parking programs and a lack of enforcement of the regulations are rampant problems facing today's parking programs, leading to a significant dilution in the intended benefits.

For example, a small municipality that institutes a permit-based parking program may face the task of issuing from 20,000 to 500,000 permits per year, which requires a complete overhaul of the municipality's existing parking regulation enforcement plan.

While the issuance of permits assists in the institution of parking regulations, use of conventional permits includes many disadvantages. Conventional permits are typically embodied as a sticker that either affixes to a window of the vehicle or a hang-tag that hangs within the vehicle (i.e., from the rear view mirror). However, it is often difficult to determine if a permit is present based on a visual inspection of the vehicle, due to a variety of factors including the presence of tinted windows and/or the arrangement of the vehicle (e.g., angled parking). This creates a significant burden on the individual responsible for inspecting vehicle to determine if the vehicle is legally parked, referred to as a Parking Enforcement Officer (PEO), who must locate and read the permit via a visual inspection of the vehicle.

In addition, conventional permits are frequently stolen or "scalped" (i.e., sold by the authorized permit holder to an unauthorized person). With no efficient means to track the permits administered under a parking program, such misuse is extremely difficult to detect and terminate.

Therefore, there is a need for a method and a system for efficiently and effectively implementing, managing, administering, and monitoring a permit-based parking program.

SUMMARY OF THE INVENTION

The above-described problems are addressed and a technical solution is achieved in the art by a system and a method for managing a permit-based parking environment. The "permit-based parking environment" includes a permit management system, one or more RFID readers, and a number of parking permits each having a unique RFID tag and tag identifier (e.g., a tag number including a series of alphanumeric characters).

According to an embodiment of the invention, the permit management system, referred to as the "PermitView" system, provides for the efficient administration, management, and enforcement of the permit-based parking program (herein referred to as the "parking program") which governs the permit-based parking environment.

According to an embodiment of the present invention, each permit included in the parking program is assigned a unique RFID tag identifier (e.g., a tag number), which is stored on an RFID tag attached to or embedded in the permit (e.g., in the form of an RFID chip). The RFID tag identifier is associated with information or data specifically related to that parking permit, including, but not limited to, authorized vehicle data, permit holder data, and parking privilege data (collectively referred to as the "tag data").

According to an embodiment of the present invention, the PermitView system includes a computer-accessible memory for storing the RFID tag identifier and associated tag data for each permit maintained by the parking program, to allow for the ongoing management throughout the life of the permit.

According to an embodiment of the present invention, the one or more parking areas of the permit-based parking environment which are regulated under the parking program, herein referred to as the "zones," are monitored by one or more RFID readers, which may be a handheld device operated by a Parking Enforcement Officer (PEO) or a stationary reader. The RFID reader scans the parked vehicle, reads the RFID tag, and captures the RFID tag identifier. To determine if the vehicle is permissibly parked, the RFID reader accesses the computer-accessible memory of the PermitView system and looks up the tag data associated with the captured RFID tag identifier.

According to an embodiment of the present invention, the PermitView system provides for an efficient determination of whether or not the scanned vehicle is parked within the privileges associated with the permit. In the event the vehicle is parked in a manner outside the scope of parking privileges granted to that permit, an appropriate enforcement action is executed (e.g., issuance of a citation, immobilization, and/or issuance of a warning), and recorded by the PermitView system.

According to an embodiment of the present invention, the authorized vehicle data (e.g., the color, make, model, year, plate number, etc.) associated with the scanned RFID identifier is communicated to the RFID reader, for a comparison with the parked vehicle data, to determine if the permit is being used by an authorized vehicle, i.e., a vehicle associated with the permit.

According to an embodiment of the present invention, the PermitView system may be accessed via a user interface by a number of different users, such as permit holders, permit applicants, parking program managers, PermitView administrators, and the one or more readers.

According to an embodiment of the present invention, one or more docking stations, adapted for docking one or more handheld RFID readers, may access the PermitView system. The docking stations communicate with the PermitView system for synchronizing the data stored in the system and the data stored on the RFID reader. In addition, one or more stationary RFID readers may connect to the system for data synchronization.

According to an embodiment of the present invention, newly issued permits are registered in the PermitView system, which acts as a clearing house for all permits managed under the parking program. The PermitView system then tracks and monitors the use of each permit for the life of the permit.

The PermitView system provides for the effective enforcement of parking regulations, thereby creating a safe and structured parking environment which results in a realization of benefits for the permit holders and the parking program.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION OF THE INVENTION

Figure 1:
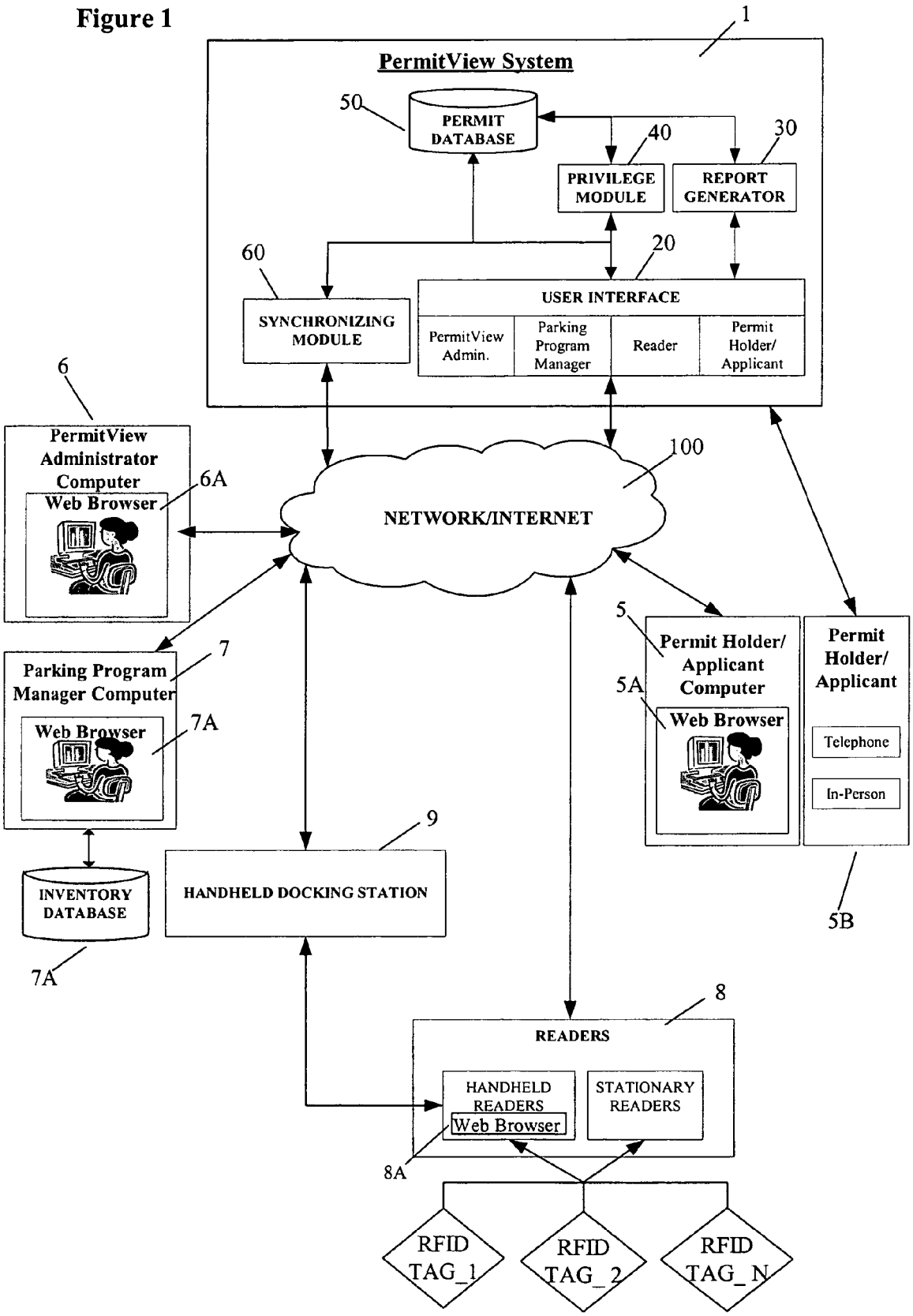
FIG. 1 is an illustration of a permit-based parking environment including a permit management system, according to an embodiment of the present invention.

The present invention relates to a method and a system for administering and managing a permit-based parking program. FIG. 1 depicts an exemplary permit-based parking environment managed by the methods and systems according to the present invention. A permit-based parking environment includes one or more parking areas or "zones," that are controlled by a parking program. The "parking program" includes the set of rules and regulations which govern parking in the zones of the permit-based parking environment.

According to an embodiment of the present invention, the permit-based parking environment includes a permit management system (herein referred to as the PermitView System 1), one or more RFID Readers 8 for scanning vehicles located in the one or more zones, and one or more parking permits each including a unique RFID tag, (referred to in FIG. 1 as RFID TAG_1, RFID TAG_2, . . . and RFID TAG-N, for a parking program having "N" number of permits). One having ordinary skill in the art will appreciate that although the present invention is described as including RFID reader technology, other reading devices and systems may be used in accordance with the invention.

According to an embodiment of the present invention, the PermitView System 1 is a computer-based system, accessible by one or more users, which includes but is not limited to the following components: a User Interface 20, a Report Generator 30, a Privilege Module 40, and a Permit Database 50. The term "computer" is intended to include any data processing device, such as a desktop computer, a laptop computer, a mainframe computer, a personal digital assistant, a server, a handheld device, or any other device able to process data. Optionally, according to an embodiment of the present invention, the Permit View System 1 may include a Synchronizing Module 60.

One having ordinary skill in the art will appreciate that the components of the PermitView System 1 may be located on a single computer, as shown in FIG. 1, or on more than one communicatively connected computers. The term "communicatively connected" is intended to include any type of connection, whether wired or wireless, in which data may be communicated. The term "communicatively connected" is intended to include a connection between devices and/or programs within a single computer or between devices and/or programs on separate computers.

One having ordinary skill in the art will appreciate that at least a portion of the PermitView System 1 may include human-based components. For example, the User Interface 20 may be a call center or conventional office wherein persons (e.g., permit holders or applicants) may access the PermitView System 1 via a telephone or in-person communication 5B, as shown in FIG. 1.

The PermitView System 1 may be a computer-executable application or program accessible by a number of user groups, wherein the characteristics of the user group dictate the level, amount, and type of permissible access to the PermitView System 1. According to an embodiment of the present invention, the following primary user groups are defined: permit holders and permit applicants, parking program managers, PermitView administrators, and RFID readers. Each user group accesses the PermitView System 1 via an appropriate User Interface 20, which may be especially adapted and/or configured based on the particular user group, as shown in FIG. 1. The User Interface 20 provides user group-specific access to the PermitView System 1, wherein the level of access is customized specifically for each user group.

The 'permit holder/applicant' user group includes all persons having or seeking one or more permits related to one or more zones supervised under the parking program. As shown in FIG. 1, the permit holder/applicant user group may access the PermitView System 1 via a permit holder/applicant portal of the User Interface 20 using a computer, herein referred to as a Permit Holder/Applicant Computer 5. One having ordinary skill in the art will appreciate that the permit holder/applicant user group may also access the PermitView System 1 via other means, such as, for example, via a telephone or in-person communication 5B, as shown in FIG. 1.

The 'PermitView administrator' user group includes all persons authorized to maintain, manage, monitor, supervise, or otherwise control the PermitView System 1. As shown in FIG. 1, the PermitView administrator user group accesses the PermitView System 1 via a PermitView administrator portal of the User Interface 20 using a computer, herein referred to as a PermitView Administrator Computer 6.

The 'parking program manager' user group includes all persons authorized to maintain, manage, monitor, supervise, or otherwise control the permit-based parking program being managed by the PermitView System 1. As shown in FIG. 1, the parking program manager user group accesses the PermitView System 1 via a parking manager portal of the User Interface 20 using a computer, herein referred to as a Parking Manager Computer 7. One having ordinary skill in the art will appreciate that the parking program manager user group may access a call center and/or office-based User Interface 20 via a telephone or in-person communication.

The 'reader' user group includes any device, preferably a RFID device, adapted to scan vehicles, or readable devices enclosed therein, in the one or more zones. As shown in FIG. 1, the reader user group accesses the PermitView System 1 via a Reader portal of the User Interface 20 using a communicatively connected Reader 8.

According to an embodiment of the present invention, the Permit Holder Computer 5, the Permit View Administrator Computer 6, the Permit Manager Computer 7, and the Reader 8 may each include a Web Browser 5A, 6A, 7A, 8A, respectively, that provides a portal to one or more Web-based networks, such as, for example, a Network/Internet 100. Each Web Browser 5A, 6A, 7A, 8A is communicatively connected to the PermitView System 1 via the Network/Internet 100. One having ordinary skill in the art will appreciate that any Web browser is suitable for use in the present invention, including but not limited to FireFox, Microsoft® Internet Explorer, Netscape, Opera, WebTV®, and Mozilla™.

According to a preferred embodiment, the Reader 8 may be any suitable device or computer capable of reading a RFID tag. The Reader 8 may be a handheld device operated by a PEO, or a stationary device. One having ordinary skill in the art will appreciate that the Readers 8 may be passive, active, or semi-active. The Reader 8 may include one or more software applications or programs (e.g., RFID/Barcode scanning and permit evaluation software such as PermitFinder, citation writing software, etc.) configured to execute the functions performed the Readers 8, including, but not limited to, data capture, data storage, and scanning activity. Suitable Readers 8 for use with the present invention include, but are not limited to, the Symbol MC9000-G RFID device. One having ordinary skill in the art will appreciate that the parking permit may include any readable device or means, other than a RFID tag. Accordingly, the Reader 8 may be any device capable of reading the readable device or means that are associated with the parking permit.

According to an embodiment of the present invention, one or more handheld docking stations 9, adapted for docking one or more handheld Readers 8, may be communicatively connected to the PermitView System 1 via the Network/Internet 100. A handheld Reader 8 may be docked in the handheld docking station 9 for synchronizing the data stored in the PermitView System 1 with the data stored on the handheld Reader 8.

According to an embodiment of the present invention, the handheld docking station 9 may communicatively connect to the PermitView System 1 via the Synchronization Module 60. The Synchronizing Module 60 may be a computer-executable module capable of downloading and/or uploading data to and from the one or more Readers 8 docked in the docking station 9. Specifically, the Synchronizing Module 60 may download/upload data including, but not limited to, lists of valid permits, software updates, PEO identification information, a list of scans performed by the PEO, a list of the scan results including any enforcement action taken (i.e., issued citations), announcements and alerts for PEOs, a list of malfunction notices (described in greater detail with respect to FIG. 2), etc. An exemplary Synchronization Module 60 suitable for use in the present invention is the SQL 2000/CE Synchronization Tool.

According to an embodiment of the present invention, the data stored on the handheld Reader 8 and in the PermitView System 1 may be synchronized in real-time via a wireless connection between the Reader 8 and the PermitView System 1.

According to an embodiment of the present invention, the PermitView System 1 includes a Report Generator 30. The Report Generator 30 is a computer-executable module configured to generate reports relating to the parking program. One having ordinary skill in the art will appreciate that a variety of reports may be generated by the Report Generator 30, said reports including any information related to the parking program which is maintained by the PermitView System 1.

Exemplary reports which may be generated include, but are not limited to, reports relating to: 1) financial information (e.g., receivables of the parking program; 2) scan results; 3) PEO-specific reports including PEO performance information (e.g., number of scans, number of warning/notices, number of citations, number of times the PEO failed to take action, etc.); 4) permit holder account information; 5) permit inventory; 6) enforcement action information; 7) parked vehicle data; and 8) tag data.

The user groups (permit holders/applicants, parking program managers, readers, and/or PermitView administrators) may submit a request for a report to the Report Generator 30 via the User Interface 20. Based on the report request, the Report Generator 30 retrieves the appropriate information from the communicatively connected computer-accessible memory, referred to the Permit Database 50, generates the report, and provides the report to the requesting user group, via the User Interface 20 or the Synchronizing Module 60. The term "computer-accessible memory" is intended to include any computer-accessible data storage device or database, whether volatile or nonvolatile, electronic, optical, or otherwise, including but not limited to, floppy disks, hard disks, CD-ROMs, DVDs, flash memories, ROMs, and RAMs.

One having ordinary skill in the art will appreciate that the Report Generator 30 may be configured to automatically run reports at one or more specific intervals of time (e.g., hourly, daily, weekly, monthly, yearly, etc.) according to a pre-determined and customizable schedule. For example, the Report Generator 30 may run a daily report detailing each violation that occurred in a particular zone during the previous 24 hour period, and automatically deliver said report to the Parking Program Manager Computer 7 and/or the Reader 8 associated with that zone.

According to an embodiment of the present invention, the Report Generator 30 may automatically receive report requests from the communicatively connected Synchronizing Module 60, pursuant to a pre-determined schedule. For example, the Synchronizing Module 60 may send a daily request for a report providing permit data updates, for communication with the one or more Readers 8 docked in the Handheld Docking Station 9.

According to an embodiment of the present invention, when the Handheld Docking Station 9 detects the docking of a Reader 8, it may automatic send a report request to the Synchronizing Module 60. The Synchronizing Module 60 may then send the request to the Report Generator 30 for fulfillment. For example, the Handheld Docking Station 9 may be configured to automatically request a report including updated permit holder information for a particular zone associated with a specific Reader 8, each time that the specific Reader 8 is docked in the Handheld Docking Station 9.

Figure 2:
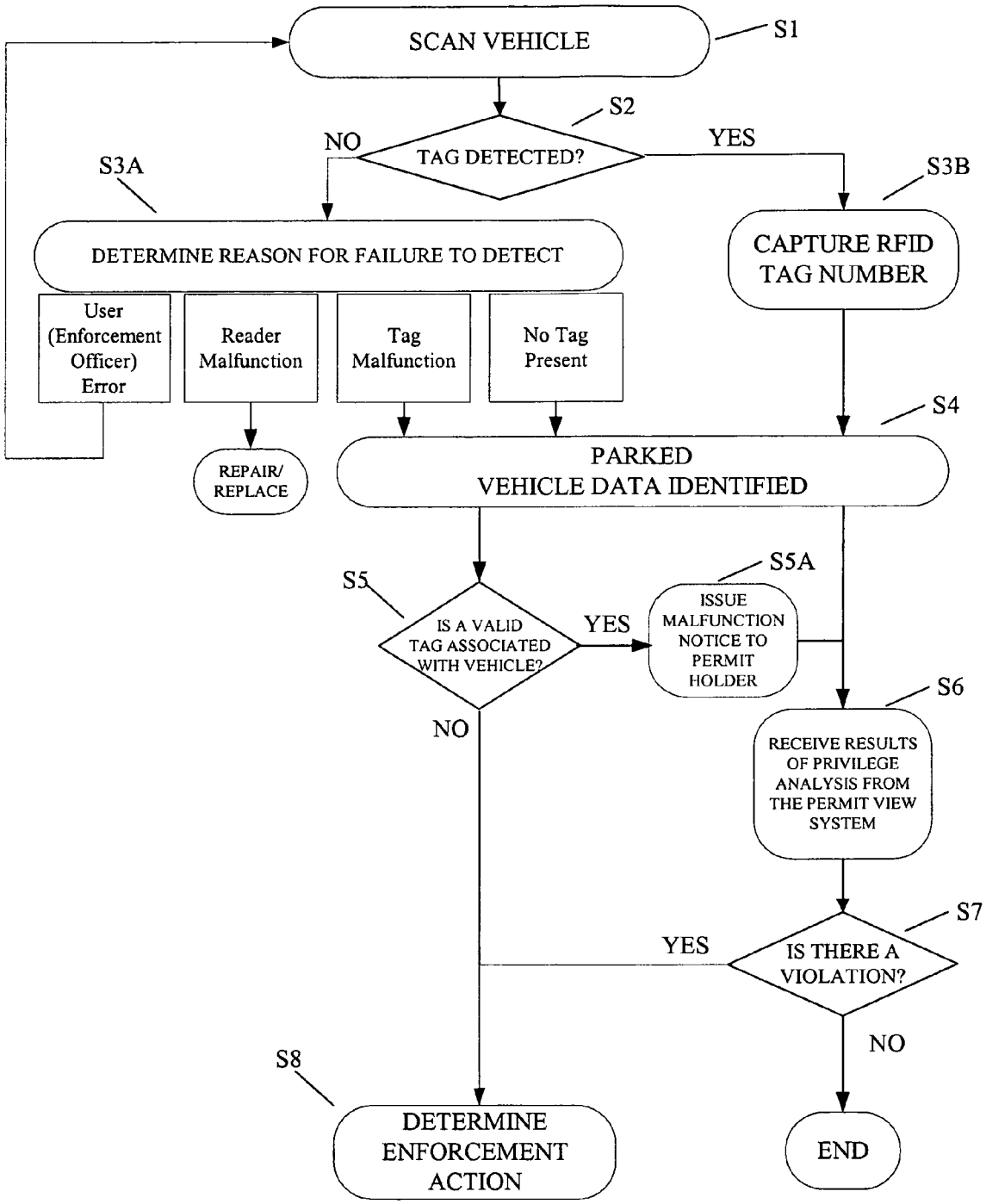
FIG. 2 illustrates an exemplary process for managing a permit-based parking environment, according to an embodiment of the present invention.

FIG. 2 illustrates an exemplary process flow for monitoring a permit-based parking environment to determine if the vehicle(s) parked therein are permissibly parked. It is to be understood that the schematic representation provided in FIG. 2 is exemplary in nature and alternative arrangements are within the scope of the invention.

In step S1, a Reader 8 scans a vehicle parked in a permit-based parking zone managed by the PermitView System 1. The Reader 8 scans the vehicle to determine if it includes a parking permit having a valid RFID tag. One having ordinary skill in the art will appreciate that the permit may be in the form of a sticker affixed to the vehicle or an article hanging within the vehicle. The Reader 8 may be a stationary reader or, as described herein in accordance with an embodiment of the present invention, a handheld reader operated by a PEO. According to an embodiment of the present invention, the RFID Reader 8 is configured to detect and read a permit and corresponding RFID tag from a distance. In addition, one having ordinary skill in the art will appreciate that the Reader 8 may perform the scan while the Reader 8 is in motion.

In step S2, the Reader 8 determines if a RFID tag is detected. If no tag is detected, the Reader 8 and/or the PEO determines the reason for the failure to detect a tag, at step S3A.

During step S3A, if it is determined that the failure to detect a tag is due to an error by the reader operator, i.e., the PEO, the vehicle is scanned again, at step S1. If the failure to detect a tag is due to reader malfunction, the Reader 8 is repaired or replaced.

Alternatively, during step S3A, it may be determined that the failure to detect a tag is due to either a tag malfunction or the absence of a tag. In either case, in step S4, the PEO identifies information related to the parked vehicle under review, referred to as the "parked vehicle data," and enters the parked vehicle data into the Reader 8. The parked vehicle data may include, but is not limited to, the following information: 1) the make, model, year, and color of the vehicle; 2) the license plate number of the vehicle; 3) the location of the parked vehicle (e.g., the lot, street, and/or zone); and 4) the date, time, and day of the week of the scan. One having ordinary skill in the art will appreciate that the PEO may enter the parked vehicle data into the Reader 8 using any suitable input means, such as, for example, a keyboard, a keypad, and/or a voice recognition system.

The parked vehicle data is used to determine if a valid tag is associated with the scanned vehicle, in step S5. For example, if upon visual inspection of the vehicle the PEO determines that no permit/tag is present, or, there is a tag/permit present but the tag is malfunctioning, the license plate number of the vehicle may be looked up in the PermitView System 1 to determine if a valid tag is associated with the vehicle. If so, the PEO may issue a notice or warning to the permit holder concerning the holder's failure to properly display the permit/tag or permit malfunction, in step S5A. According to an embodiment of the present invention, the PermitView System 1 may track the number of such notices issued to a particular permit holder, and, if the number exceeds a certain threshold (i.e., three prior warnings), an appropriate enforcement action may be taken (e.g., the issuance of a citation or immobilization of the vehicle). An enforcement action may include, but is not limited to one or more of the following: 1) the issuance of a citation or summons; 2) the issuance of a notice or warning; 3) immobilization of the vehicle (i.e., booting) and/or 4) no action.

If during step S5 it is determined that no valid tag is associated with the parked vehicle, a determination is made as to the appropriate enforcement action, in step S8.

Alternatively, if during step S2 a tag is detected, the Reader 8 captures the unique RFID tag identifier, herein referred to as the "tag number," in step S3B, and identifies the parked vehicle data, in step S4. One having ordinary skill in the art will appreciate that the tag number may be any length string of alphanumeric characters capable of uniquely identifying the particular permit with which it is associated. According to an embodiment of the present invention, the tag number is stored on the RFID tag embedded in or attached to the permit.

Figure 3:
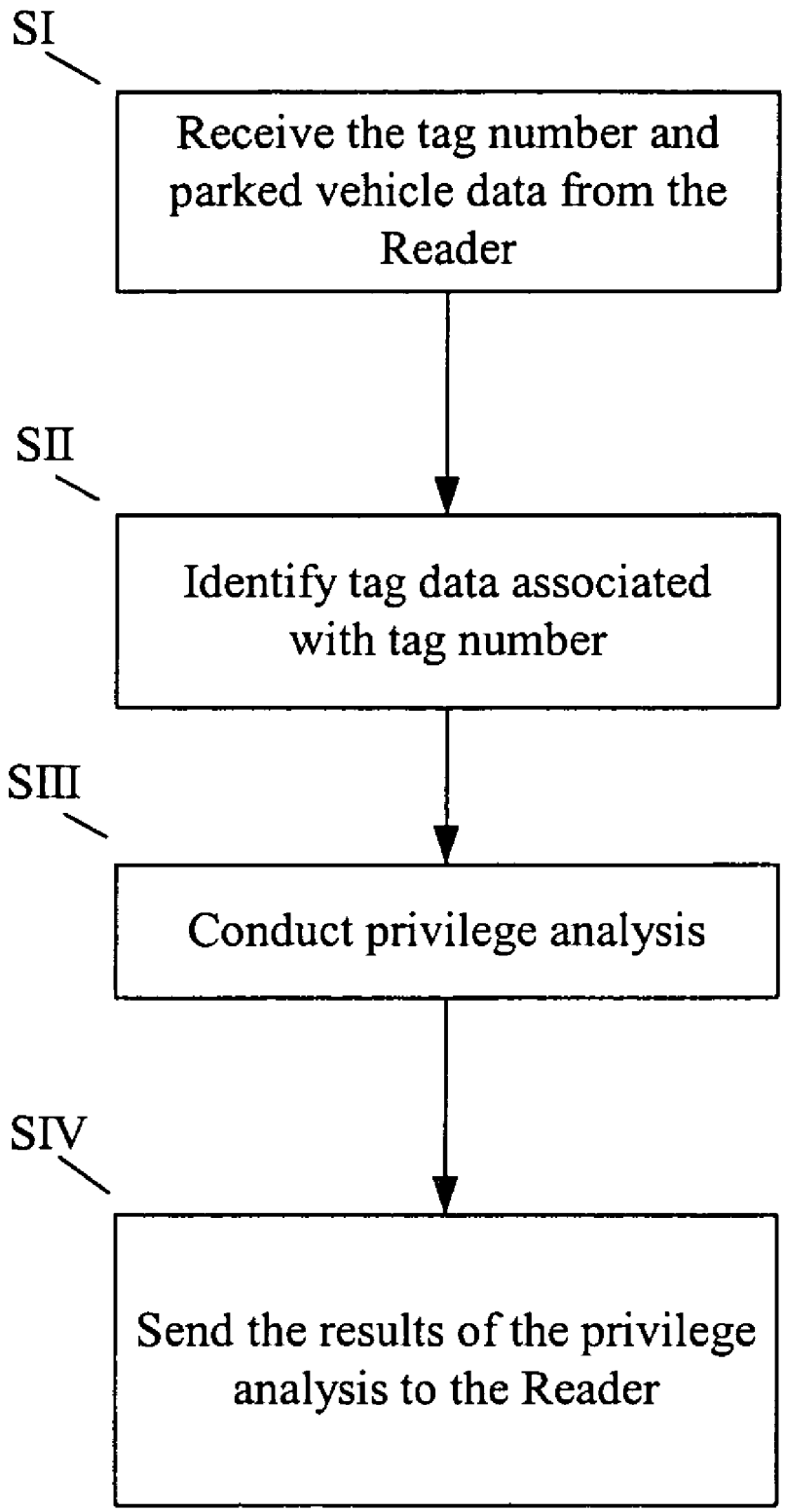
FIG. 3 illustrates an exemplary process performed by a permit management system, according to an embodiment of the present invention.

Having captured the RFID tag number and parked vehicle data, the Reader 8 sends this data to the PermitView System 1. FIG. 3 illustrates at least a portion of the steps of the permit management process performed by the PermitView System 1. As shown in FIG. 3, the PermitView System 1 receives the tag number and parked vehicle data from the Reader 8 via the User Interface 20, in step S1. The information is provided to the Privilege Module 40, which in turn retrieves the tag data associated with the tag number from the Permit Database 50, in step SII.

According to an embodiment of the present invention, the "tag data" includes, but is not limited to, the following information: 1) authorized vehicle data; 2) permit holder data; and/or 3) parking privilege data. The "authorized vehicle data" includes, but is not limited to the make, model, color, year, and/or license plate number of the vehicle or vehicles authorized under a valid permit. The "permit holder data" includes, but is not limited to, the permit holder's name, address, phone number, e-mail address, and/or facsimile number. The "parking privilege data" generally defines the scope of privileges or parking rights held by the permit holder, including, but is not limited to: a) the one or more locations, zones, streets, lots, spaces, or areas the vehicle is permitted to park; b) the term of the permit and/or the permit's expiration date; and/or c) the valid parking time or times (i.e., weekend-only rights; weekday-only rights, seasonal rights, etc.).

In step SIII, the Privilege Module 40 conducts the privilege analysis, described in detail below with respect to FIG. 4. In step SIV, after conducting the privilege analysis, the Privilege Module 40 sends the results of the privilege analysis to the Reader 8.

Returning to the process illustrated in FIG. 2, in step S8, if it is determined that there is a violation based on the privilege analysis (see step S7) or, as described above, no valid tag is associated with the parked vehicle (see step S5), a determination is made as to the appropriate enforcement action to be taken. One having ordinary skill in the art will appreciate that the determination as to the appropriate enforcement action may be made by the PermitView System 1 (as part of the privilege analysis), the PEO, or by a parking program manager.

Figure 4:
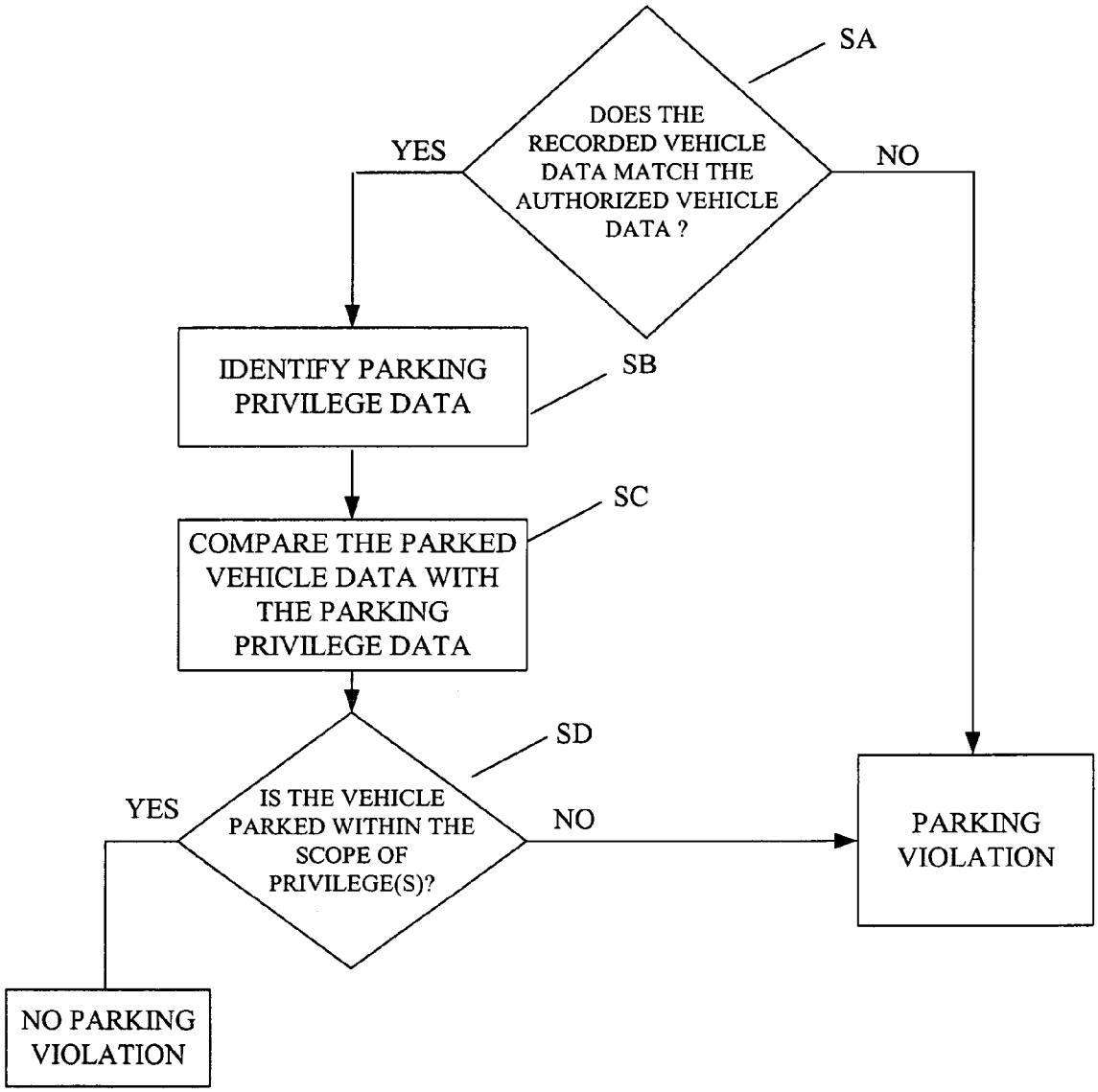
FIG. 4 illustrates steps according to an exemplary privilege analysis, according to an embodiment of the present invention.

FIG. 4 illustrates the steps involved in an exemplary privilege analysis, according to an embodiment of the present invention. Generally, the privilege analysis is performed by the PermitView System 1, and includes, but is not limited to, a comparison of the parked vehicle data to the parking privilege data associated with the permit assigned to the parked vehicle. In step SA, the Privilege Module 40 determines whether or not the parked vehicle data matches the authorized vehicle data associated with the scanned tag number in the Permit Database 50. If the data does not match, then there is a misuse of the parking permit, and a parking violation has occurred. For each parking violation that occurs, the Permit Database 50 stores information related to the parking violation, referred to as "parking violation data." The parking violation data may include, but is not limited to, the parked vehicle data (i.e., the information related to the violating vehicle); the vehicle owner's information (as derived from the license plate number), the PEO information, the type of enforcement action taken, etc. For example, a permit that has been stolen or illegally transferred to unauthorized vehicle will result in this type of mismatch, and corresponding parking violation. According to an embodiment of the present invention, if a misuse of the permit is detected, the PermitView System 1 may place a temporary hold on the permit, thereby signaling to the PEO(s) that the permit is inactive or invalid.

Alternatively, the PermitView system 1 may communicate the authorized vehicle data associated with the scanned permit to the Reader 8. Then, based on a visual inspection of the vehicle, the PEO may determine whether or not there is a mismatch between the parked vehicle data and the authorized vehicle data.

If the data matches, the Privilege Module 40 identifies the parking privilege data (i.e., the scope of privileges) assigned to the permit, in step SB. According to an embodiment of the present invention, the parking privilege data may be defined in the parking program at the time of issuance of the permit, or at the time of a subsequent update or edit. For example, a permit holder, John Smith, may have a permit which includes parking privileges for zone "C"/Main Street, Hoboken, N.J./Monday-Friday/between the hours of 6 PM and 7 AM. In addition, the same permit may also include privileges allowing John Smith, a student enrolled in summer classes at Rutgers University, to park his vehicle in campus parking lot "11"/zone "H"/spaces "19-27"/from June $1^{st}$ through August $15^{th}$. Collectively, these parking privileges make up the parking privilege data associated with John Smith's parking permit.

Referring to FIG. 4, in step SC, the Privilege Module 40 compares the parked vehicle data with the parking privilege data. Next, in step SD, a determination is made as to whether the vehicle is parked within the scope of the privileges. If not, then it is determined that a parking violation has occurred, and the parking violation data is recorded and stored in the Permit Database 50. One having ordinary skill in the art will appreciate that the parking violation determination may be made by the PermitView System 1, the PEO, or a parking program manager.

In the example set forth above, assume John Smith's vehicle is parked in parking lot 9/zone "B"/space 6 on June $17^{th}$. In step SC, this parked vehicle data is compared with the parking privilege data, resulting in a determination that a parking violation has occurred, in step SD. According to an embodiment of the present invention, the Privilege Module 40 communicates the results of the privilege analysis to the Reader 8 for the execution of an appropriate enforcement action. In addition, the parking violation data is stored in the Permit Database 50.

According to an embodiment of the present invention, the PermitView System 1 may be accessed by both existing and prospective permit holders via the permit holder/applicant portal of the User Interface 20. The User Interface 20 may include an authentication or login screen which prompts existing permit holders to provide login information (e.g., a username and password). One having ordinary skill in the art will appreciate that any suitable authentication system or method may be used in accordance with the present invention, such as, for example, ASP.Net WebForms-based authentication. A permit holder may access information related to his or her account, and perform a number of account-related tasks, including, but not limited to the following: 1) add/edit/delete/update the authorized vehicle data; 2) add/edit/delete/update the permit data; 3) add/edit/delete/update permit holder data; 4) make bill, renewal, and/or citation payments; and 5) review account information including previously issued warnings/notices and/or citations; etc.

According to an embodiment of the present invention, a person may access the PermitView System 1 to submit a new permit application. The new permit application may include, but is not limited to, the permit holder data, the vehicle or vehicles associated with the permit, the requested scope of privileges, a means for payment, and/or the proof required for the issuance of a permit. The proof required to obtain a permit may include, but is not limited to proof of residency or eligibility for residential parking privileges (e.g., a utility bill, a driver's license, a real estate tax bill, etc.), proof of employment for employee parking privileges, proof of matriculation for student parking privileges, proof of personal identification (e.g., a driver license, social security card, etc.). According to an embodiment of the invention, this information may be electronically scanned and transmitted to the PermitView System 1 in any suitable file format, such as, for example, a Portable Document Format (PDF).

One having ordinary skill in the art will appreciate that an inventory of available and/or issued permits may be managed, stored, and maintained by the PermitView System 1 in a database, such as, for example, the Permit Database 40. Alternatively, the inventory may be stored in a separate database, referred to as Inventory Database 7B in FIG. 1, managed and maintained by the parking program manager, via the Parking Manager Computer 7. According to this embodiment, new applications may be received by the PermitView System 1 and communicated to the Parking Manager Computer 7 for review and evaluation.

According to an embodiment of the present invention, a PermitView administrator may access the PermitView System 1 via the PermitView administrator portal of the User Interface 20. Preferably, an increased or relatively higher level of authentication is required for access via the administrator portal due to the type and amount of access the administrator has to the PermitView System 1.

According to an embodiment of the present invention, the one or more administrators may access the PermitView System 1 to perform a number of functions, including, but not limited to: 1) setting up and administering new parking programs; 2) providing online support; 3) managing user groups; 4) setting parking privilege data in accordance with the parameters of the parking program; 5) managing permit inventory; 6) processing new permit applications; 7) managing warning/notice and citation issuance; 8) defining and providing reports to the user groups; and 9) management of billing and invoicing processes.

According to an embodiment of the present invention, a parking program manager may access the PermitView System 1 via the parking program manager portal of the User Interface 20. As compared to the other user groups, the parking program managers require a unique level and type of access to the PermitView System 1. According to an embodiment of the present invention, the one or more administrators may access the PermitView System 1 to perform a number of functions, including, but not limited to: 1) running a variety of reports related to the parking program; 2) setting up and administering new parking programs; 3) updating/editing existing permit holder data; 4) managing permit inventory; and 5) tracking enforcement action information.

It is to be understood that the exemplary embodiments are merely illustrative of the invention and that many variations of the above-described embodiments may be devised by one skilled in the art without departing from the scope of the invention. It is therefore intended that all such variations be included within the scope of the following claims and their equivalents.

What is claimed is:

1. A permission-based parking environment system comprising:

at least one identification device, the identification device being associated with first permit holder information;

at least one identification device reader, the identification device reader capable of reading the identification device and obtaining the first holder information associated with the identification device, the identification device reader further capable of receiving parked vehicle data from an input device;

at least one computing system, the computing system including a permit holder database, a user interface and an enforcement database, the permit holder database having second permit holder information and parking privilege information, the user interface allowing an individual permit holder to access and modify the second permit holder information and the parking privilege information, the parking privilege information including pre-defined parking rights associated with the individual permit holder based upon specific parking requirements unique to the individual permit holder, the enforcement database having parking violation rules and enforcement instructions, the pre-defined parking rights including specific parking areas and specific times in which the individual permit holder may park as defined by the individual permit holder, the computing system being communicately connected to the identification device reader and capable of receiving the parked vehicle data and the first holder information from the identification device reader; and a parking violation module associated with the computing system, the parking violation module analyzing the first permit holder information, the second permit holder information, the parked vehicle data, the parking privilege information and the parking violation rules in order to determine if a violation occurred, and if so, recommending enforcement instructions based upon the violation.

2. The permission-based parking environment system of claim 1 wherein the enforcement instructions are transmitted to the identification device reader.

3. The permission-based parking environment system of claim 2 wherein the enforcement instructions include issuance of a citation, issuance of a warning, immobilizing a vehicle, taking of no action and combinations thereof.

4. The permission-based parking environment system of claim 1 wherein the connection between the computing system and the identification device reader is a wireless connection.

5. The permission-based parking environment system of claim 1 wherein the first permit holder information includes a tag identification number.

6. The permission-based parking environment system of claim 1 wherein the second permit holder information includes a permit's holder name, address, phone number, license plate number, vehicle description and combinations thereof.

7. The permission-based parking environment system of claim 1 wherein the pre-defined parking rights further includes an expiration of the pre-defined parking rights.

8. The permission-based parking environment system of claim 1 wherein the parking violation rules are a set of rules and regulations that govern parking in a permission-based parking environment.

9. The permission-based parking environment system of claim 8 wherein the permission-based parking environment has at least one zone.

10. The permission-based parking environment system of claim 1 wherein the parked vehicle data includes a description of vehicle, a location of vehicle, a parking zone in which a vehicle is parked and combinations thereof.

11. The permission-based parking environment system of claim 1 wherein the input device of the identification device reader is one of a keyboard, a keypad, and a voice recognition device.

12. The permission-based parking environment system of claim 1 wherein the identification device is an RFID tag, a sticker, an article hanging within a vehicle or a license plate.

13. The permission-based parking environment system of claim 1 wherein the computing system further includes a user interface for allowing certain parties to access the computing system.

14. The permission-based parking environment system of claim 1 wherein the computing system further includes a report generator for generating reports related to the permission-based parking environment system.

15. The permission-based parking environment system of claim 1 wherein the computing system further includes a synchronizing module for synchronizing the data reader and the computing system in real-time.

16. The permission-based parking environment system of claim 1 wherein the parking violation module includes a computer-executable program for analyzing the first permit holder information, the second permit holder information, the parked vehicle data, the parking privilege information and the parking violation rules.

17. The permission-based parking environment system of claim 1 wherein the parking violation module includes a computer-executable program for determining if a parking violation occurred.

18. The permission-based parking environment system of claim 1 wherein the parking violation module includes a computer-executable program for recommending enforcement instructions.

19. The permission-based parking environment system of claim 1 wherein the identification device reader is a handheld device.

20. The permission-based parking environment system of claim 1 wherein the identification device reader is a stationary device mounted in or on an enforcement vehicle.

21. The permission-based parking environment system of claim 1 wherein the violation is a parking violation or a scofflaw violation.

22. A permission-based parking environment system comprising:

at least one identification device, the identification device being associated with first permit holder information, the first permit information being associated with a particular vehicle;

at least one identification device reader, the identification device reader capable of reading the identification device and obtaining the first holder information associated with the particular vehicle, the identification device reader further capable of receiving parked vehicle data from an input device;

at least one computing system, the computing system including a permit holder database, a user interface and an enforcement database, the permit holder database having second permit holder information and parking privilege information, the user interface allowing an individual permit holder to access and modify the second permit holder information and the parking privilege information, the parking privilege information defining specific parking areas and specific times in which the particular vehicle may park as defined by the individual permit holder, the enforcement database having parking violation rules and enforcement instructions, the computing system being communicately connected to the identification device reader and capable of receiving the parked vehicle data and the first holder information from the identification device reader; and a parking violation module associated with the computing system, the parking violation module analyzing the first permit holder information, the second permit holder information, the parked vehicle data, the parking privilege information and the parking violation rules in order to determine if a violation occurred, and if so, recommending enforcement instructions based upon the violation.

* * * * *